US010299589B1

(12) United States Patent
Lai et al.

(10) Patent No.: US 10,299,589 B1
(45) Date of Patent: May 28, 2019

(54) FRAME HOOKING AND COMBINING STRUCTURE

(71) Applicant: Shenter Enterprise Co., Ltd., Chang-Hua Hsien (TW)

(72) Inventors: Ming-Hsiao Lai, Chang-Hua Hsien (TW); Kuo-Shu Huang, Changhua (TW)

(73) Assignee: SHENTER ENTERPRISE CO., LTD., Chang-Hua Hsien (TW)

( * ) Notice: Subject to any disclaimer, the term of this patent is extended or adjusted under 35 U.S.C. 154(b) by 0 days.

(21) Appl. No.: 16/030,447

(22) Filed: Jul. 9, 2018

(51) Int. Cl.

| | |
|---|---|
| ***A47B 47/02*** | (2006.01) |
| ***A47B 57/40*** | (2006.01) |
| ***A47B 95/00*** | (2006.01) |
| ***A47B 96/07*** | (2006.01) |
| ***A47B 96/14*** | (2006.01) |

(52) U.S. Cl.
CPC ..... *A47B 95/00* (2013.01); *A47B 47/028* (2013.01); *A47B 57/40* (2013.01); *A47B 57/402* (2013.01); *A47B 57/406* (2013.01); *A47B 57/408* (2013.01); *A47B 96/07* (2013.01); *A47B 96/145* (2013.01); *A47B 96/1433* (2013.01); *A47B 96/1441* (2013.01); *A47B 2220/00* (2013.01)

(58) Field of Classification Search
CPC . A47B 95/00; A47B 96/1433; A47B 96/1441; A47B 2220/00; A47B 96/14; A47B 96/1416; A47B 96/145; A47B 96/1458; A47B 96/06; A47B 96/068; A47B 96/07; A47B 47/021; A47B 47/027; A47B 47/028; A47B 47/02; A47B 57/30; A47B 57/40; A47B 57/402; A47B 57/406; A47B 57/408; A47B 57/48; A47B 57/482
USPC ..... 211/103, 182, 191, 192, 190, 188, 194; 248/218.4, 219.3, 220.21, 235, 241, 250
See application file for complete search history.

(56) References Cited

U.S. PATENT DOCUMENTS

| | | | | | |
|---|---|---|---|---|---|
| 2,576,865 | A * | 11/1951 | Vanderveld | A47B 57/408 | 248/220.43 |
| 3,127,995 | A * | 4/1964 | Mosinski | A47B 57/402 | 211/182 |
| 3,346,126 | A * | 10/1967 | Bloom | A47B 57/487 | 211/192 |
| 3,794,281 | A * | 2/1974 | Munsey | E04B 2/7416 | 248/188 |
| 4,079,678 | A * | 3/1978 | Champagne | A47B 57/545 | 108/106 |

(Continued)

*Primary Examiner* — Jennifer E. Novosad
(74) *Attorney, Agent, or Firm* — Egbert Law Offices, PLLC

(57) ABSTRACT

A frame hooking and connecting structure includes a column, each side of which is formed with a first through hole, and a parallel second through hole. A first support rod is provided to hook the column. The two ends of the first support rod are extended with a fastening part, and the free end of the fastening part is connected with a first hook, which is hooked and positioned to the bottom edge of the first through hole, and the fastening part is attached to a corresponding end surface of the column. A second support rod is provided to hook the column. The ends of the second support rod are respectively extended with a second hook, and the free end of the second hook penetrates through the hollow portion and the second through hole into the column, and is locked to the bottom edge of the second through hole.

8 Claims, 4 Drawing Sheets

(56) References Cited

U.S. PATENT DOCUMENTS 4,154,419 A * 5/1979 Breidenbach ..... A47B 57/402 108/110
4,285,436 A * 8/1981 Konstant ..... A47B 57/482 211/192
4,342,397 A * 8/1982 Halstrick ..... A47B 57/402 211/182
4,406,374 A * 9/1983 Yedor ..... A47B 57/40 211/192
4,618,064 A * 10/1986 Viklund ..... A47B 57/40 211/192
4,934,858 A * 6/1990 Beaulieu ..... F16B 12/40 403/174
4,955,743 A * 9/1990 King ..... A47B 57/50 403/254
5,025,937 A * 6/1991 King ..... A47B 57/22 211/192
5,048,698 A * 9/1991 Konrad ..... A47F 5/0846 211/103
5,180,068 A * 1/1993 Vargo ..... F16B 12/10 211/191
5,377,851 A * 1/1995 Asano ..... A47B 47/022 211/191
5,456,435 A * 10/1995 Sweeney ..... A47B 57/40 211/90.01
5,975,318 A * 11/1999 Jay ..... A47F 5/101 211/150
6,273,281 B1 * 8/2001 Berglund ..... A47B 57/50 108/107
6,481,678 B1 * 11/2002 Chong ..... H02G 3/288 211/192
6,626,407 B1 * 9/2003 Miller ..... A47B 57/42 211/192
8,353,494 B2 * 1/2013 Peng ..... A47B 88/43 211/192
8,602,372 B2 * 12/2013 Yu ..... H05K 7/1489 211/192
8,672,150 B2 * 3/2014 Chen ..... A47B 57/50 108/147.16
2001/0013209 A1 * 8/2001 Waalkes ..... A47B 21/06 52/239
2002/0195408 A1 * 12/2002 Hegrenes ..... H05K 7/183 211/26
2004/0104184 A1 * 6/2004 Hartman ..... G06F 1/183 211/26
2007/0062898 A1 * 3/2007 Choi ..... A47B 57/408 211/192
2017/0086579 A1 * 3/2017 Kam ..... A47B 57/485

* cited by examiner

FRAME HOOKING AND COMBINING STRUCTURE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present utility model relates generally to a frame hooking and combining structure, and more particularly to an innovative structure with good structural strength and low production cost.

2. Description of Related Art Including Information Disclosed Under 37 CFR 1.97 and 37 CFR 1.98

The length, width, and height of a combined frame can be arbitrarily assembled according to the actual needs of a user and the placement space. Therefore, for the storage and display of articles, it can be said as a very handy product.

The traditional frame structure mainly consists of four columns, two beams, two side plates and one bearing plate. The column is provided with a jointing wall, and the joint wall is provided with a number of first buckle holes and a number of second buckle holes from top to bottom at different height positions. The beam has a first plate body, and two ends of the first plate body are respectively provided with a first buckle body perpendicular to the first plate body. The bottom of the first buckle body is provided with a first buckle groove that can buckle the first buckle hole of the column, and one side of the first buckle body is disposed with a third buckle hole. The side plate has a second plate body. Two side of the second plate body is extended with a second buckle body, and a second buckle groove is arranged below. The bearing plate is a square body, and is disposed above the two beams and the two side plates. After the first buckle body of the beam buckles the first button hole of the column, the positions of the second and third buckle holes correspond. The second buckle body of the side plate can be inserted into the third and the second buckle holes, and the second buckle groove can simultaneously clamp the jointing wall of the column and the first plate body of the beam. Accordingly, the combined frame of the present utility model can have better assembly convenience and stability.

However, in the actual use experience, the conventional structural pattern still has the following problems. The beam and the first plate body as well as the side plate and the second plate body disclosed in the present utility model are all integrally molded. In considering the fastening strength, thin metal sheet cannot be adopted for both the cross beam and the side plate. Under the situation of forced use of thick metal plates, the purchase cost of metal plate is virtually increased. In addition, because the cross beam and the corresponding first plate body as well as the side plate and the corresponding second plate body are all integrally molded, in order to meet the different size requirements of consumers, the manufacturer must prepare multiple forming molds of different lengths. The high cost of these molds will certainly be passed on to the consumers, so it will greatly reduce the market competitiveness of the products.

BRIEF SUMMARY OF THE INVENTION

The technical feature of the present utility model to solve the problem lies mainly in the frame hooking and connecting structure, comprising a column having a polygonal cross section; each side of the column is formed with at least one first through hole, and at least one second through hole which is parallel to at least one first through hole, wherein the at least one first through hole and the at least one second through hole longitudinally correspond to the column; at least one first support rod is provided to hook the column; the two ends of the at least one first support rod are respectively extended with a fastening part, and the free end of the fastening part is connected with at least one first hook; the at least one first hook is hooked and positioned to the bottom edge of the at least one first through hole, and the fastening part is attached to a corresponding end surface of the column; the fastening part is formed with at least one hollow portion, and the area of the at least one hollow portion at least partially covers the area of the at least one second through hole; the at least one first support rod is a tubular structure body with a rectangular cross section, and the fastening part is fixed to the inner wall of the long side of the at least one first support rod; at least one second support rod is provided to hook the column; the two ends of the at least one second support rod are respectively extended with a second hook, and the free end of the at least one second hook penetrates through the at least one hollow portion and the at least one second through hole into the interior of the column, and is locked to the bottom edge of the at least one second through hole, thereby clamping to the corresponding fastening part relative to the column; the at least one second support rod is a tubular structure body with a rectangular cross section, and the at least one second hook is fixed to the inner wall of the long side of the at least one second support rod.

With this innovative and unique design, compared to the prior art, the present utility model can reduce the thickness of the at least one first support rod and the at least one second support rod without affecting the structural strength. Furthermore, because the fastening part and the at least one second hook are respectively designed to be integrated with the at least one first support rod and the at least one second support rod, the length of the at least one first support rod and the at least one second support bar can be freely cut according to the user's needs without using any forming mold to achieve a practical progress and a better industrial economy benefit to significantly reduce production costs and increase market competitiveness.

DETAILED DESCRIPTION OF THE INVENTION

Figure 1:
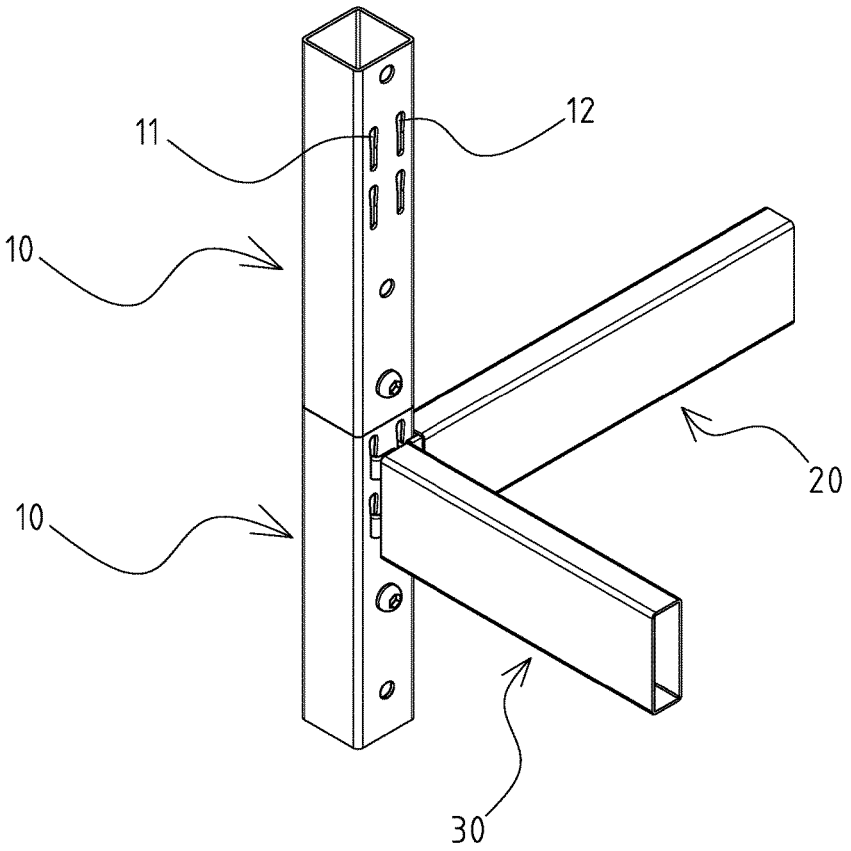
FIG. 1 is a partial appearance of the present utility model after completion of the combination.
Figure 2:
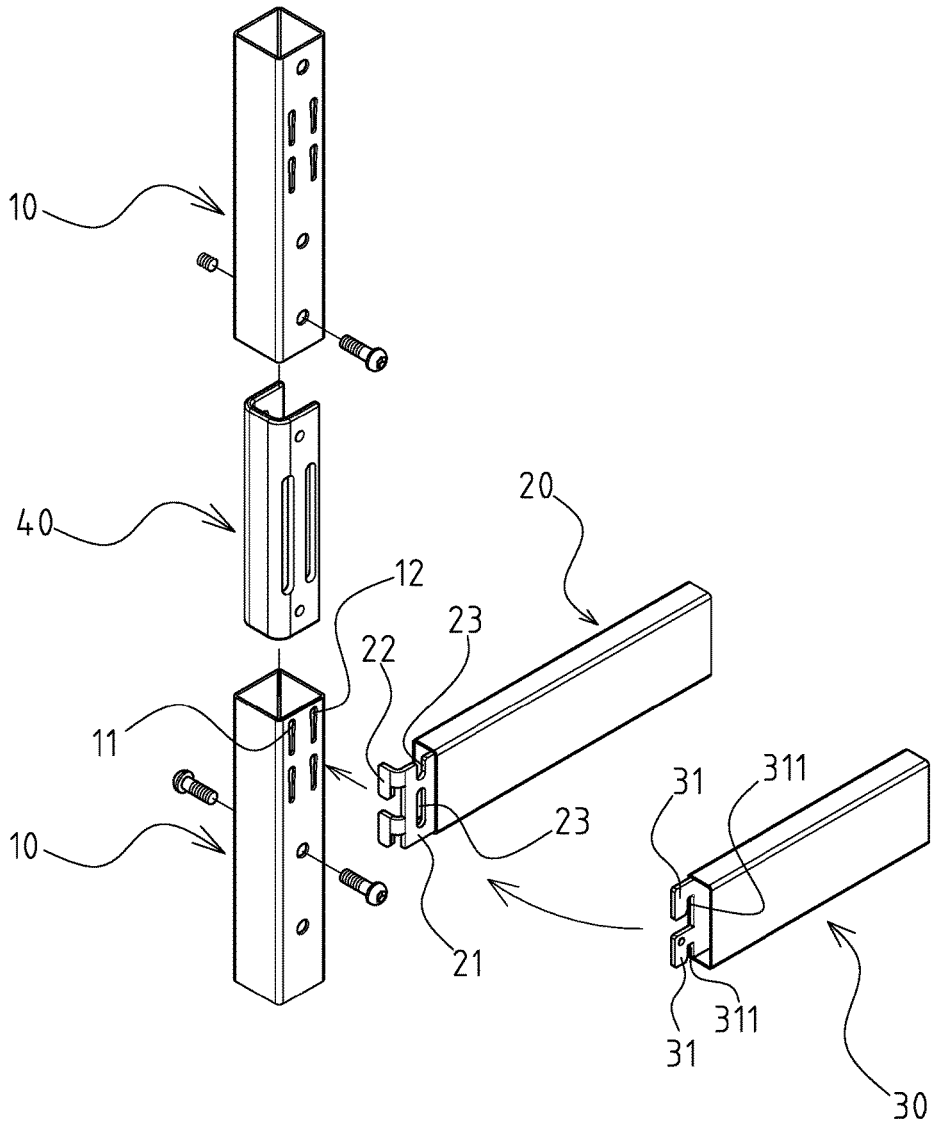
FIGS. 2-3 are schematic diagrams of the combination of the column, the first support rod and the second support rod of the present utility model.
Figure 3:
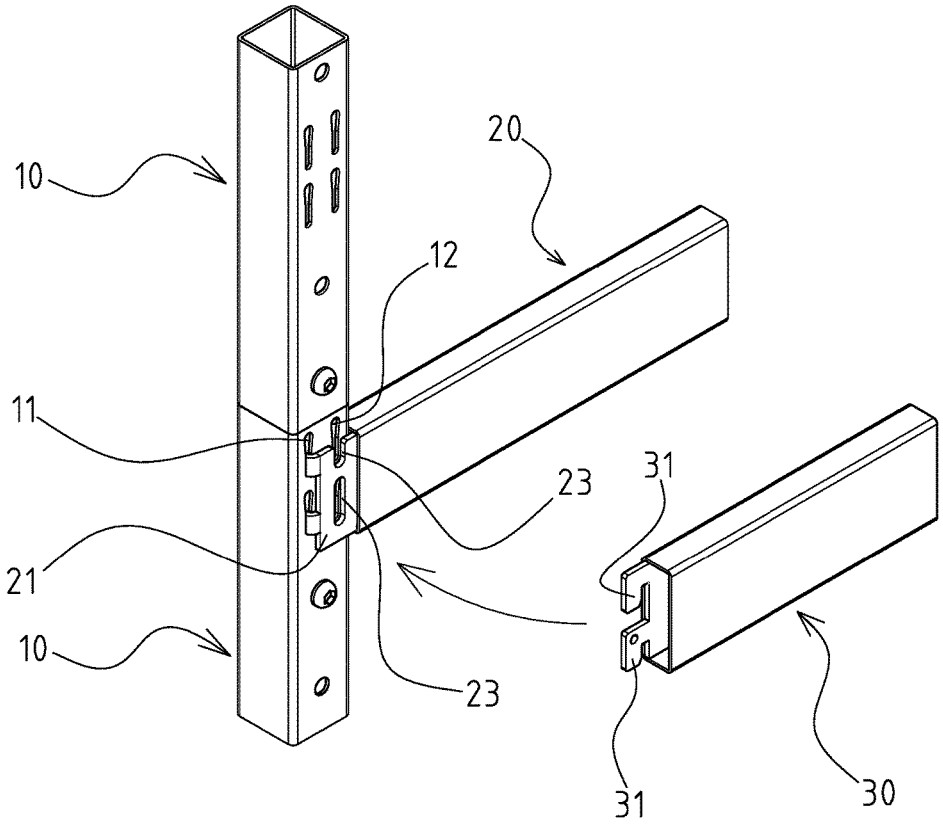
Figure 4:
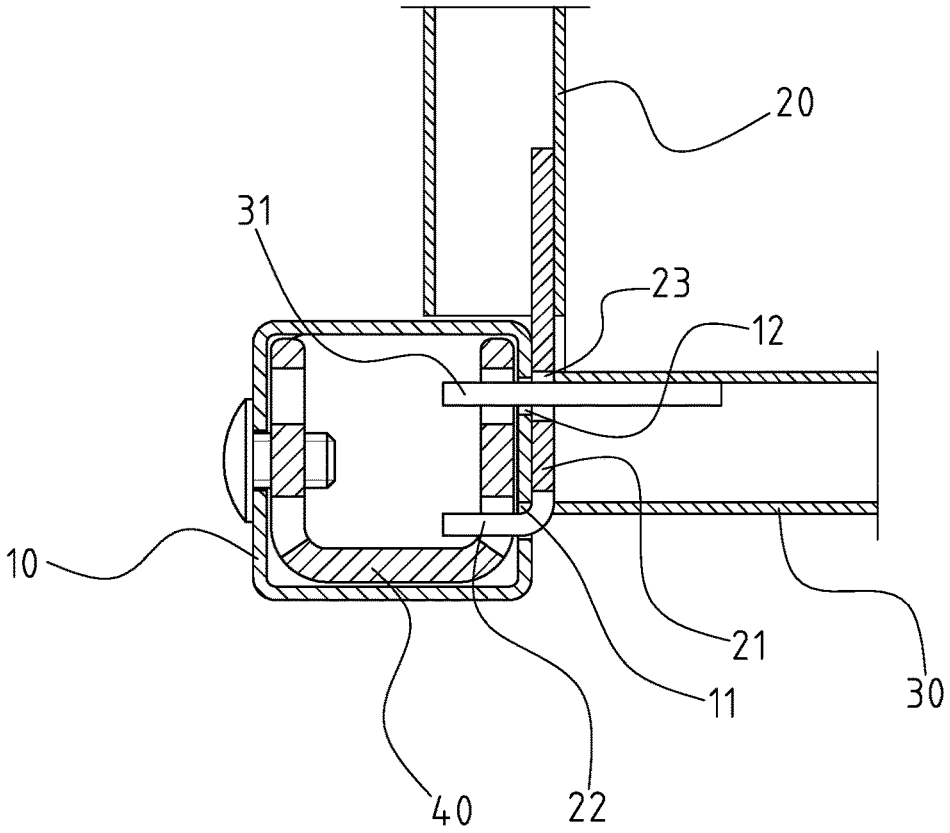
FIG. 4 is a combination sectional view of the second hook of the first preferred embodiment of the present utility model.

Referring to FIGS. 1 to 4, which are preferred embodiments of the frame hooking and combining structure of the present utility model, this embodiment is for illustrative purposes only, and is not limited by the patent application. The frame hooking and combining structure comprises a column 10, which has a polygonal cross section. Each side of the column 10 is formed with at least one first through hole 11, and at least one second through hole 11 which is parallel to at least one first through hole 11, wherein at least one first through hole 11 and the at least one second through hole 12 longitudinally correspond to the column 10. At least one first support rod 20 is provided to hook the column 10. The two ends of the at least one first support rod 20 are respectively extended with a fastening part 21, and the free end of the fastening part 21 is connected with at least one first hook 22. The at least one first hook 22 is hooked and positioned to the bottom edge of the at least one first through hole 11, and the fastening part 21 is attached to a corresponding end surface of the column 10. The fastening part 21 is formed with at least one hollow portion 23, and the area of the at least one hollow portion 23 at least partially covers the area of the at least one second through hole 12. The at least one first support rod 20 is a tubular structure body with a rectangular cross section, and the fastening part 21 is fixed to the inner wall of the long side of the at least one first support rod 20. At least one second support rod 30 is provided to hook the column 10. The two ends of the at least one second support rod 30 are respectively extended with a second hook 31, and the free end of the at least one second hook 31 penetrates through the at least one hollow portion 23 and the at least one second through hole 12 into the interior of the column 10, and is locked to the bottom edge of the at least one second through hole 12, thereby clamping to the corresponding fastening part 21 relative to the column 10. The at least one second support rod 30 is a tubular structure body with a rectangular cross section, and the at least one second hook 31 is fixed to the inner wall of the long side of the at least one second support rod 30.

In a preferred embodiment of the present utility model, the at least one first through hole 11 is an upper-wide and lower-narrow structure, so that the at least one first hook 22 is firmly caught at the bottom edge of the at least one first through hole 11. The at least one second through hole 12 is an upper-wide and lower-narrow structure, and the bottom of the at least one second hook 31 is formed with a notch 311 extending upwardly. The at least one notch 311 is an upper-narrow and lower-wide structure, so that the at least one second hook 31 is firmly clamped at the bottom edge of the at least one second through hole 12, and further clamped to the corresponding fastening part 21 relative to the column 10. In addition, the cross section of the column 10 is selected from one of a regular polygon and a rectangle.

In a preferred embodiment of the present utility model, if the cross sections of the at least one first support rod 20 and the at least one second support rod 30 are rectangular, in order for the at least one first support rod 20 and the at least one second support rod 30 to have a flat appearance, the outer side surface of the fastening part 21 and the outer wall of the long side of the at least one first support rod 20 are on the same plane. The outer side wall of the at least one second hook 31 and the outer wall of the long side of the at least one second support rod 30 are located on the same plane.

In a preferred embodiment of the present utility model, in order for the at least one first support rod 20 and the at least one second support rod 30 to have better bonding strength with the column 10, the at least one first through hole 11 is longitudinally arranged in groups of two on the column 10. The at least one second through hole 12 is longitudinally arranged in groups of two on the column 10, and each first through hole 11 horizontally corresponds to a corresponding second through hole 12. The free end of the fastening part 21 is connected with two up-and-down longitudinally arranged first hooks 22, and the fastening part 21 is formed with two up-and-down longitudinally arranged hollow portions 23. Two ends of the at least one second support rod 30 are respectively extended with two up-and-down longitudinally arranged second hooks 31.

In addition, the preferred embodiment of the present utility model further includes at least one series-connecting member 40. The at least one series-connecting member 40 is axially connected to two coaxial columns 10.

To sum up, compared to the traditional structure, the present utility model in the design of the structure does have the following advantages. In the preferred embodiment of the present utility model, the at least one first support rod 20 and the at least one second support rod 30 all are selected from the rectangular metal pipes, and the mounting of the at least one first support rod 20 and the at least one second support rod 30 all adopt a mode in which the long sides are perpendicular to the force bearing surface. Therefore, a better support strength can be provided and the thickness of the at least one first support rod 20 and the at least one second support rod 30 can be greatly reduced to lower the material purchase cost. Moreover, the first support rod 20 and the second support rod 30 and the fastening part 21 and the second hook 31 of the present utility model are respectively processed, and then bonded together by welding. Because the first support rod 20 and the second support rod 30 are acquired from commercially available rectangular pipes, length can be arbitrarily processed and cut according to the user's needs. Therefore, it suffices to prepare two molds for processing the fastener part 21 and the second hook 31, which can greatly reduce the cost of the mold. In the process of processing, a plurality of pipes can be cut at one time, which is also of great help for increasing production capacity.

We claim:

1. A frame hooking and combining structure comprising:

a column having a polygonal cross section, a side of said column having at least one first through hole and at least one second through hole which is parallel to the at least one first through hole, wherein the at least one first through hole and the at least one second through hole arranged so as to correspond in position to each other;

at least one first support rod is hookable to the column, the at least one first support rod having a fastening part extending from an end thereof, the fastening part having a free end being connected to at least one first hook, the at least one first hook is hooked to a bottom edge of the at least one first through hole, the fastening part being attached to a corresponding end surface of said column, the fastening part having at least one hollow portion, an area of the at least one hollow portion at least partially covers the area of the at least one second through hole, said at least one first support rod being a tubular structure body with a rectangular cross section, the fastening part being affixed to an inner wall of a side extending along a length of the at least one first support rod; and at least one second support rod hookable to the column, the at least one second support rod having at least one second hook extending from an end thereof, the at least one second hook having a free end penetrable through the at least one hollow portion and the at least one second through hole into an interior of said column and locked to a bottom edge of the at least one second through hole so as to clamp to the corresponding fastening part relative to said column, said at least one second support rod being a tubular body with a rectangular cross section, the at least one second hook being affixed to the inner wall of a side extending along a length of the at least one second support rod.

2. The frame hooking and combining structure of claim 1, wherein the at least one first through hole has a width at a top thereof that is wider than a width at a bottom thereof, the at least one first hook is frictionally fixedly positioned at a bottom edge of the at least one first through hole, wherein the at least one second through hole has a width at a top thereof that is wider than a width at a bottom thereof, and a bottom of the at least one second hook has a notch extending upwardly, wherein the at least one second hook is clamped at a bottom edge of the at least one second through hole and further clamped to the corresponding fastening part relative to said column.

3. The frame hooking and combining structure of claim 2, wherein an outer side surface of the fastening part and an outer wall of the side extending along the length of the at least one first support rod are on a common plane, wherein an outer side wall of the at least one second hook and the outer wall of the side extending along the length of the at least one second support rod are located on a common plane.

4. The frame hooking and combining structure of claim 3, further comprising:

at least one series-connecting member axially connected to two of said columns arranged coaxially.

5. The frame hooking and combining structure of in claim 2, wherein the at least one first through hole is longitudinally arranged in groups of two on said column and the at least one second through hole is longitudinally arranged in groups of two on said column, and each first through hole horizontally corresponds to a corresponding second through hole, the free end of the fastening part is connected with two up-and-down longitudinally arranged first hooks, and the fastening part is formed with two up-and-down longitudinally arranged hollow portions.

6. The frame hooking and combining structure of claim 5, further comprising:

at least one series-connecting member axially connected to two of said columns arranged coaxially.

7. The frame hooking and combining structure of claim 2, further comprising:

at least one series-connecting member axially connected to two of said columns arranged coaxially.

8. The frame hooking and combining structure of claim 1, further comprising:

at least one series-connecting member axially connected to a pair of said columns arranged coaxially.

* * * * *